US007175489B2

(12) United States Patent
Fujii et al.

(10) Patent No.: US 7,175,489 B2
(45) **Date of Patent: *Feb. 13, 2007**

(54) JOINT TERMINAL, A JOINT CONNECTOR AND A PRODUCTION METHOD THEREFOR

(75) Inventors: Masayasu Fujii, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/961,012

(22) Filed: Oct. 8, 2004

(65) Prior Publication Data

US 2005/0079774 A1 Apr. 14, 2005

(30) Foreign Application Priority Data

Oct. 10, 2003 (JP) ..... 2003-352480

(51) Int. Cl.
*H01R 9/16* (2006.01)

(52) U.S. Cl. ..... 439/869; 439/884; 439/733.1

(58) Field of Classification Search ..... 439/869, 439/701, 884–885, 888–907, 507, 928, 594, 439/651, 222–224, 733.1, 608
See application file for complete search history.

(56) References Cited

U.S. PATENT DOCUMENTS 6,332,811 B1 * 12/2001 Sato ..... 439/701
6,375,518 B2 * 4/2002 Sato ..... 439/701
6,447,331 B1 * 9/2002 Fukatsu et al. ..... 439/516
6,637,106 B2 * 10/2003 Sato et al. ..... 29/878
6,805,591 B2 * 10/2004 Garland et al. ..... 439/733.1
6,814,627 B2 * 11/2004 Yamamoto et al. ..... 439/701

FOREIGN PATENT DOCUMENTS

JP 9-115612 5/1997

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

Joint terminals (20*c*) and a housing (10) are united by a press-in operation instead of being united by insert molding. Thus, there is no likelihood that an injection pressure will deform the joint terminals (20*c*). The joint terminal (20*c*) has a coupling (21) bent so that upper and lower supports (26, 27) are formed at the opposite sides of an intermediate portion (28). A high dimensional precision can be obtained even when an automatic mounting machine is used for pressing the joint terminals (20*c*) into the housing (10).

6 Claims, 12 Drawing Sheets

JOINT TERMINAL, A JOINT CONNECTOR AND A PRODUCTION METHOD THEREFOR

BACKGROUND OF THE INVENTION

1. Field of the Invention

The invention relates to a joint terminal for shorting a plurality of terminal fittings, a joint connector for shorting a plurality of terminal fittings and a production method therefor.

2. Description of the Related Art

Japanese Unexamined Patent Publication No. H09-115612 discloses a joint connector with a resin housing and a joint terminal that has a plurality of connecting portions. The joint connector is connectable with a mating housing that has a plurality of terminal fittings. Thus, the connecting portions of the joint terminal connect with and short the terminal fittings.

The above-described joint connector is formed by insert molding. Thus, the joint terminal is set in a mold, and resin is injected into the mold to form the housing around at least parts of the joint terminal. However, injection pressure generated during the insert molding can deform the joint terminal in the mold. More particularly, a small joint connector will have a small thin joint terminal that is influenced easily by the injection pressure. Further, a U-shaped joint terminal may be required to short terminal fittings arranged at upper and lower stages. The U-shaped joint terminal has two plate surfaces arranged at substantially right angles, and injection pressure influences a U-shaped joint terminal more easily than a flat joint terminal. Further, only one product can be injection molded in one molding process, and poor production efficiency is poor.

The invention was developed in view of the above problems and an object thereof is to avoid the deformation of a joint terminal upon production.

SUMMARY OF THE INVENTION

The invention relates to a joint terminal for shorting a plurality of terminal fittings arranged at first and second stages of a joint connector. The joint terminal has a plurality of tabs that can be brought into contact with the terminal fittings. The tabs are coupled by a bent coupling and can be pressed into a housing of the joint connector. The coupling may, for example, be L-shaped, U-shaped or S-shaped.

The invention also relates to a joint connector for shorting terminal fittings arranged at two stages. The joint connector has a joint terminal, as described herein, pressed into a synthetic resin housing.

The joint terminal and the housing can be united by a press-in operation instead of insert molding. Thus, injection pressure will not deform the joint terminal. Further, the press-in mounting enables a plurality of housings to be set side-by-side in an automatic machine. The joint terminals then can be mounted into the housings in one step, thereby improving production efficiency.

The joint terminal preferably is obtained by bending chained terminals that have tabs supported by a long narrow carrier. The chained terminals are fed parallel with the longitudinal direction of the carrier.

The chained terminals preferably have a first support for supporting at least one tab at the first stage and a second support for supporting at least one tab at the second stage. The supports are bent at an angle, and preferably at substantially right angles, to an intermediate portion between the first and second supports while the intermediate portion is held substantially coplanar or flush with the carrier.

A leading section of the chained terminals with respect to the feeding direction may be bent twice. This double bent joint terminal could be applied to an automatic mounting machine for mounting already-produced joint terminals into housings. However, high dimensional precision would be difficult with this method. In contrast, the method of the invention bends the first and second supports at opposite sides of the intermediate portion, while the intermediate portion is held substantially coplanar or flush with the carrier. Thus, a high dimensional precision can be obtained even when an automatic mounting machine is employed for mounting the joint terminals into the housing.

The tabs may extend from a lateral edge of the carrier and the coupling may be arranged substantially parallel with the carrier.

At least one tab preferably is coupled to an intermediate portion of the coupling between a first support that supports at least one tab at the first stage and a second support that supports at least one tab at the second stage is left coupled to the carrier. The tabs coupled to the first support and second supports are separated from the carrier, and, after the bending, the tabs are separated from the intermediate portion.

All the tabs are coupled to the carrier before bending. Thus, the tabs will not deform in the feeding process. Further, the tab is separated after bending from the intermediate portion that requires no tab. Thus, the tabs can be arranged at specified intervals and the numbers of the tabs at the upper and lower stages can be accommodated flexibly.

The chained terminals may be formed so that the coupling extends from the opposite lateral sides of the carrier, and a part of the carrier forms the intermediate portion with the already-bent coupling separated from the carrier. A material loss is smaller with this embodiment as compared to a case where the entire coupling or a major part thereof is formed separately from the carrier.

The invention also relates to a method for producing a joint terminal, and particularly one of the above-described joint terminals, for shorting a plurality of terminal fittings arranged at two stages of a joint connector.

The invention further relates to a method for producing a joint connector for shorting a plurality of terminal fittings arranged at two stages.

The joint terminal preferably is formed from chained terminals that have a plurality of tabs supported by a narrow and long carrier. The method includes bending some of the chained terminals into a substantially L- or U-shape while feeding the chained terminals substantially in parallel with the longitudinal direction of the carrier.

The bending preferably is carried out to define a first support that supports at least one tab at the first stage and a second support that supports at least one tab at the second stage. The first and second supports then are bent at angles, and preferably at substantially right angles, to an intermediate portion of the coupling between the first and second supports with the intermediate portion held substantially flush with the carrier. The bending preferably is carried out by bending a part of the chained terminals supported by the carrier into substantially L- or U- or S- or snake-shape while feeding the chained terminals in parallel with the longitudinal direction of the carrier.

The method preferably forms the chained terminals so that the tabs extend from a lateral edge of the carrier and so that the coupling is substantially parallel with the carrier.

The bending preferably is carried out so that at least one tab is coupled to the intermediate portion of the coupling between the first support and the second support. The method keeps at least one tab coupled to the intermediate portion while the tabs coupled to the first support and those coupled to the second support are separated from the carrier. The tabs then are separated from the intermediate portion after bending.

The chained terminals may be formed so that the coupling extends from the opposite lateral sides of the carrier. The already-bent coupling portion is separated from the carrier so that at least a part of the carrier is included in the intermediate portion.

The method may further comprise pressing the joint terminals into a housing for forming the joint connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
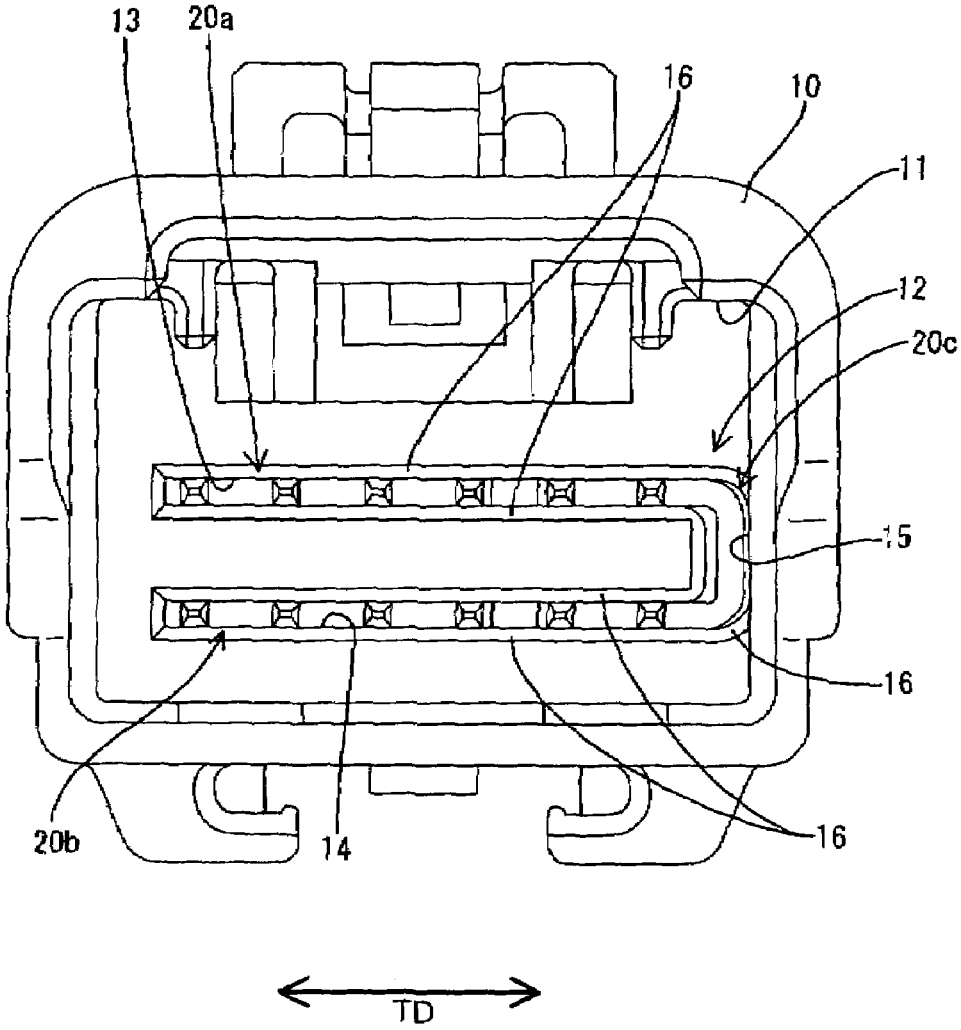
FIG. 1 is a front view of a joint connector according to a first embodiment.
Figure 2A:
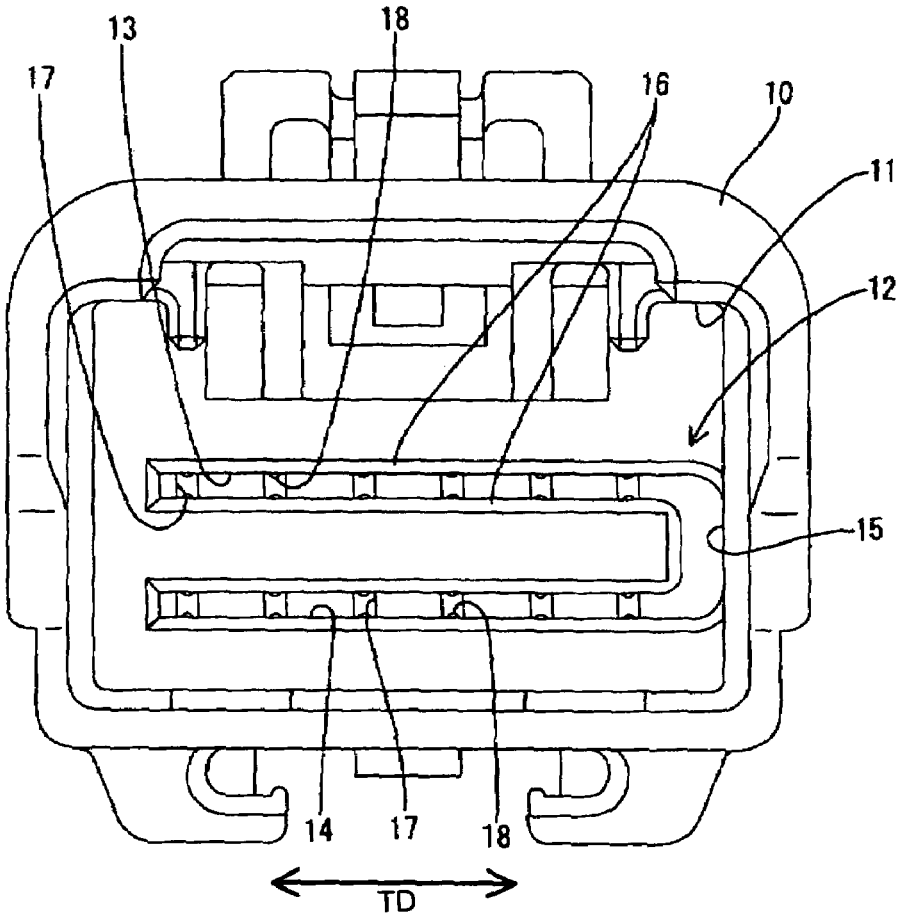
FIG. 2(A) is a front view of a housing showing a state before joint terminals are pressed into.
Figure 2B:
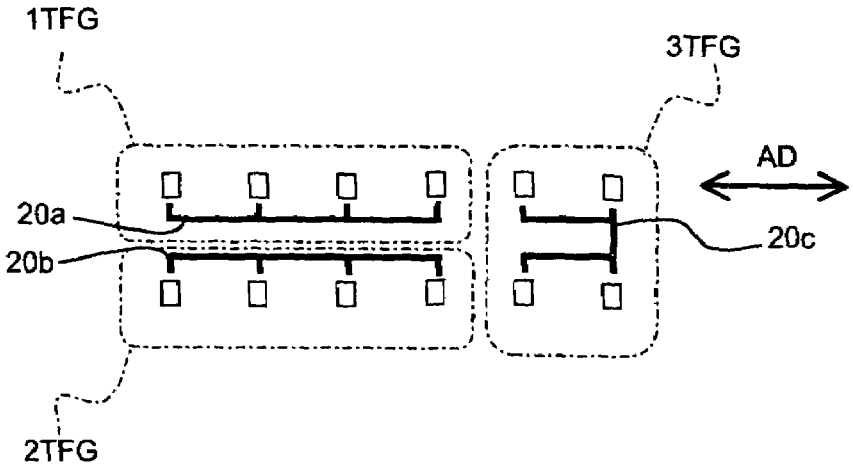
FIG. 2(B) is a schematic drawing showing the shorted terminal fitting groups.
Figure 3:
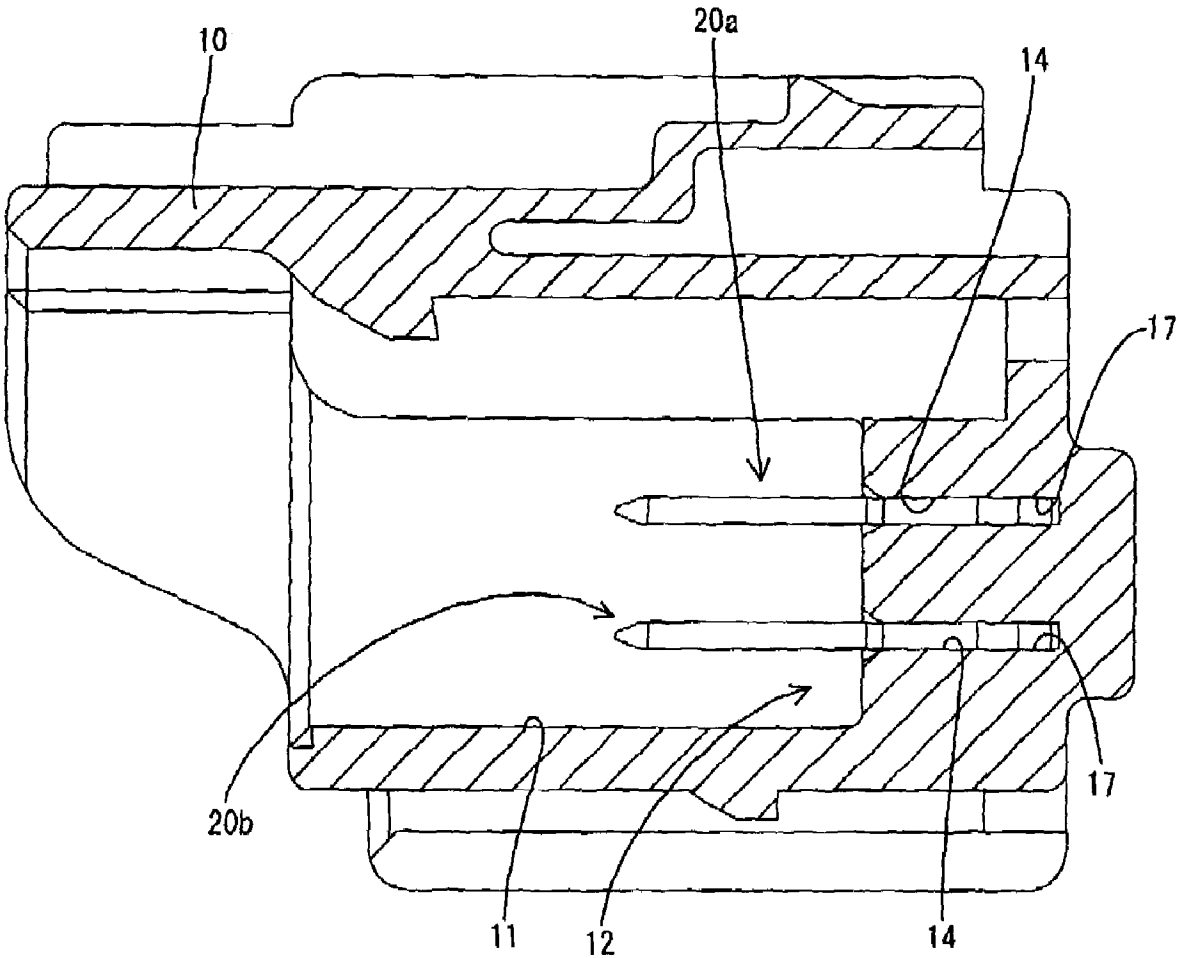
FIG. 3 is a vertical section of the joint connector.
Figure 4:
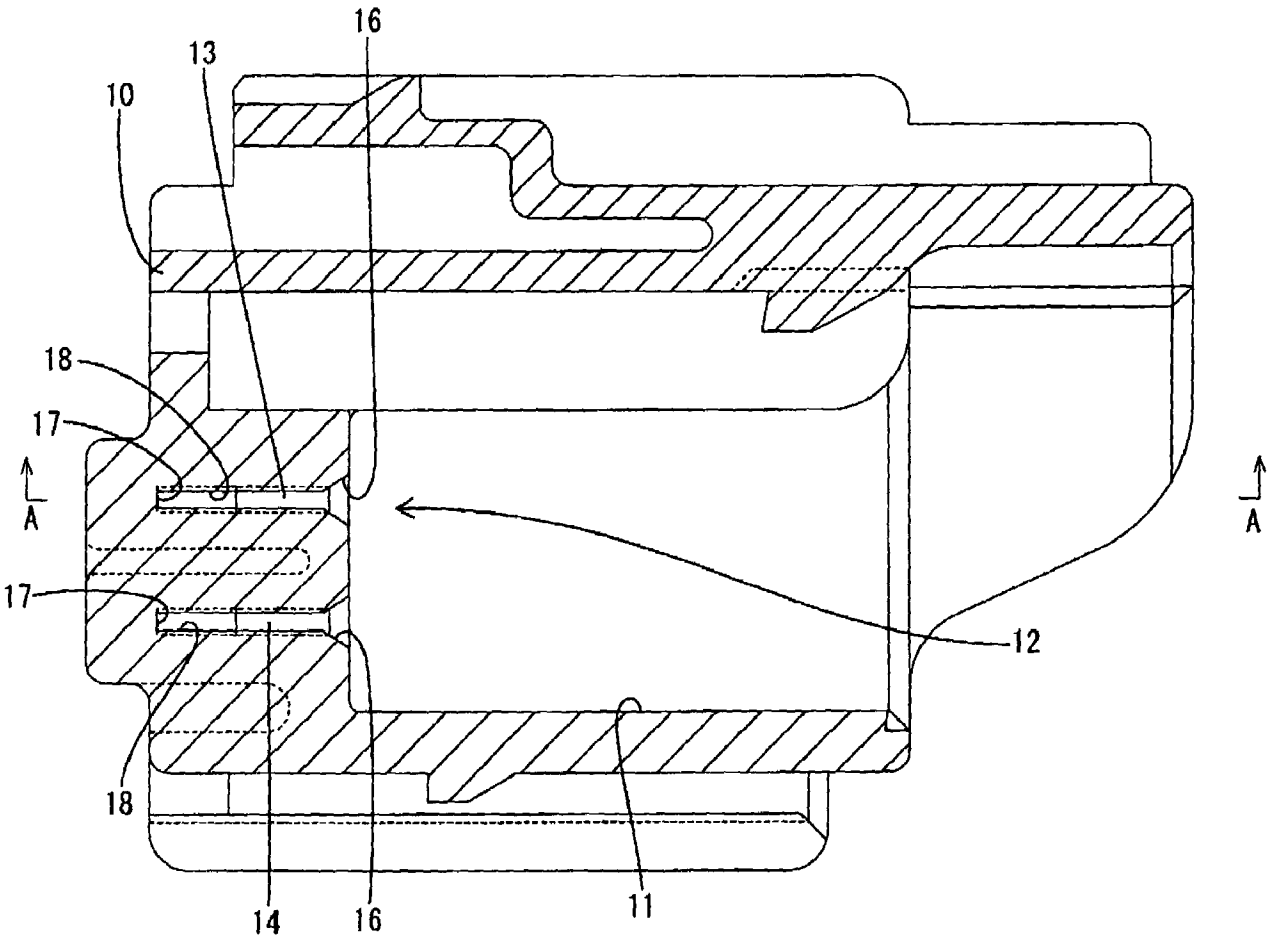
FIG. 4 is a vertical section of the housing showing the state before the joint terminals are pressed into.
Figure 5:
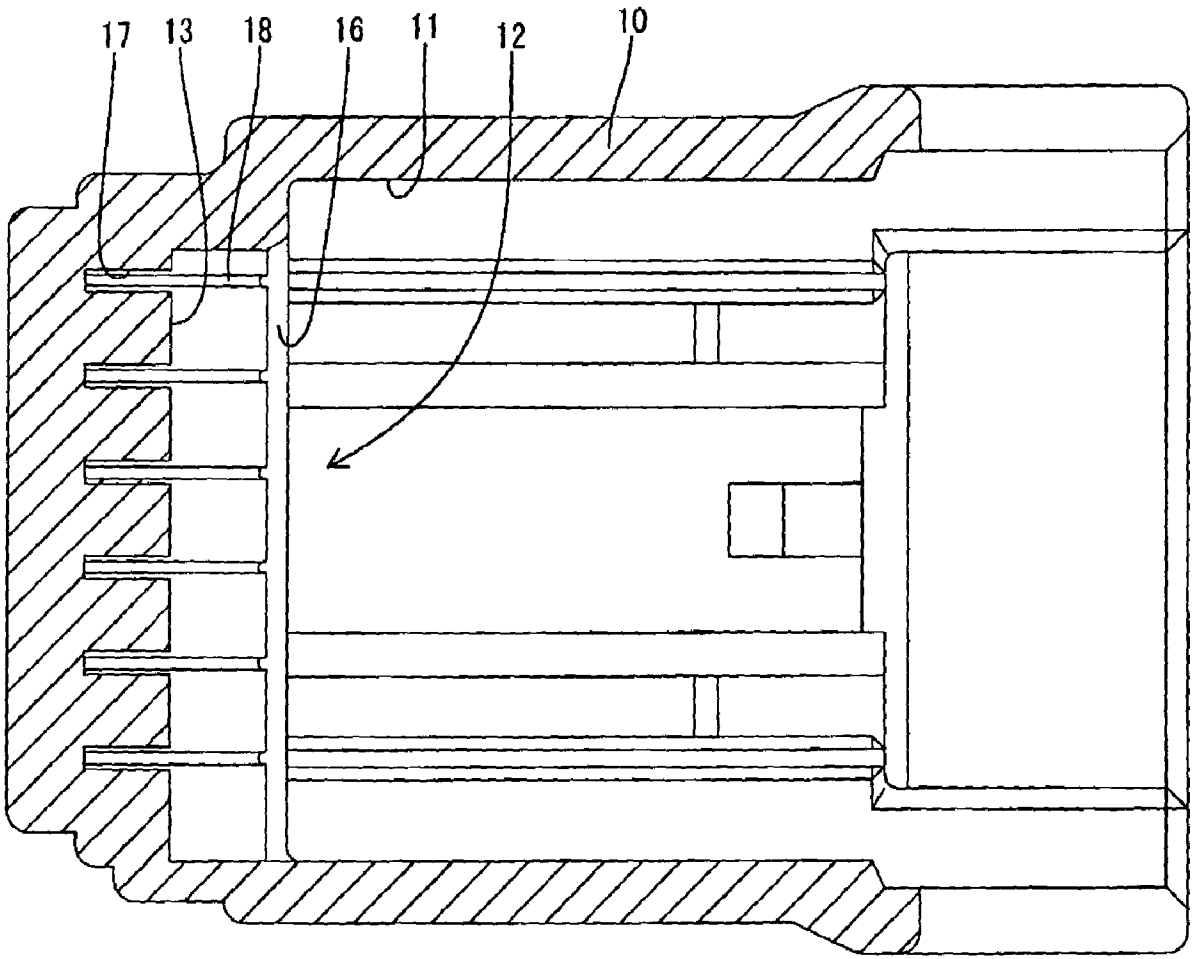
FIG. 5 is a section along 5—5 of FIG. 4.
Figure 6:
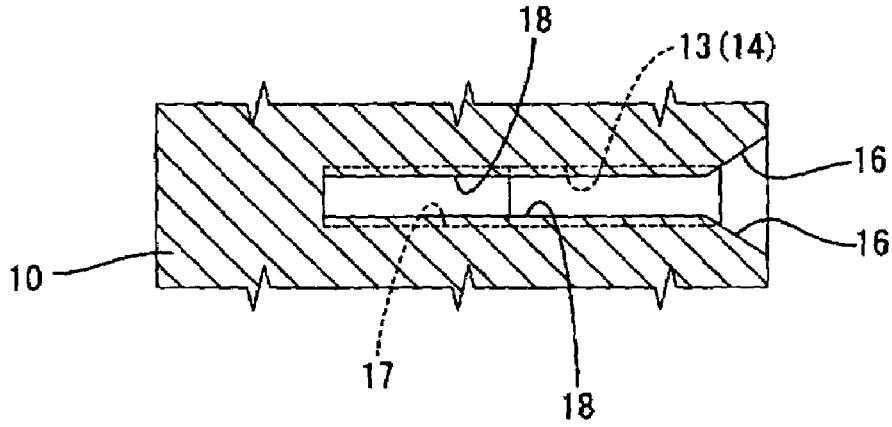
FIG. 6 is a partial enlarged vertical section of a press-in groove.
Figure 7:
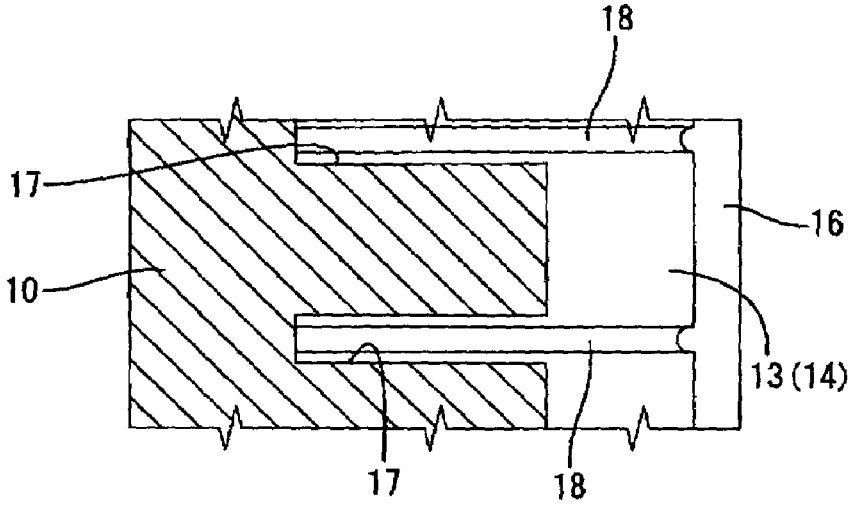
FIG. 7 is a partial enlarged horizontal section of the press-in groove.
Figure 8:
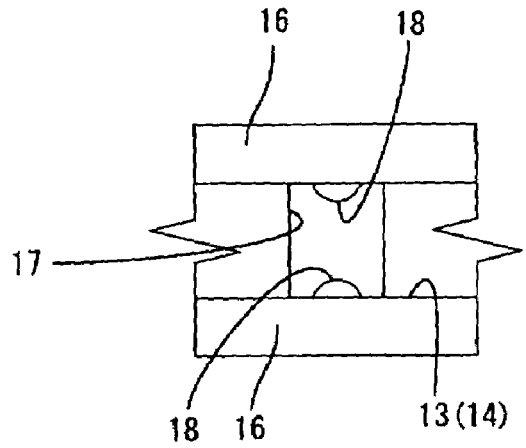
FIG. 8 is a partial enlarged front view of the press-in groove.
Figure 9:
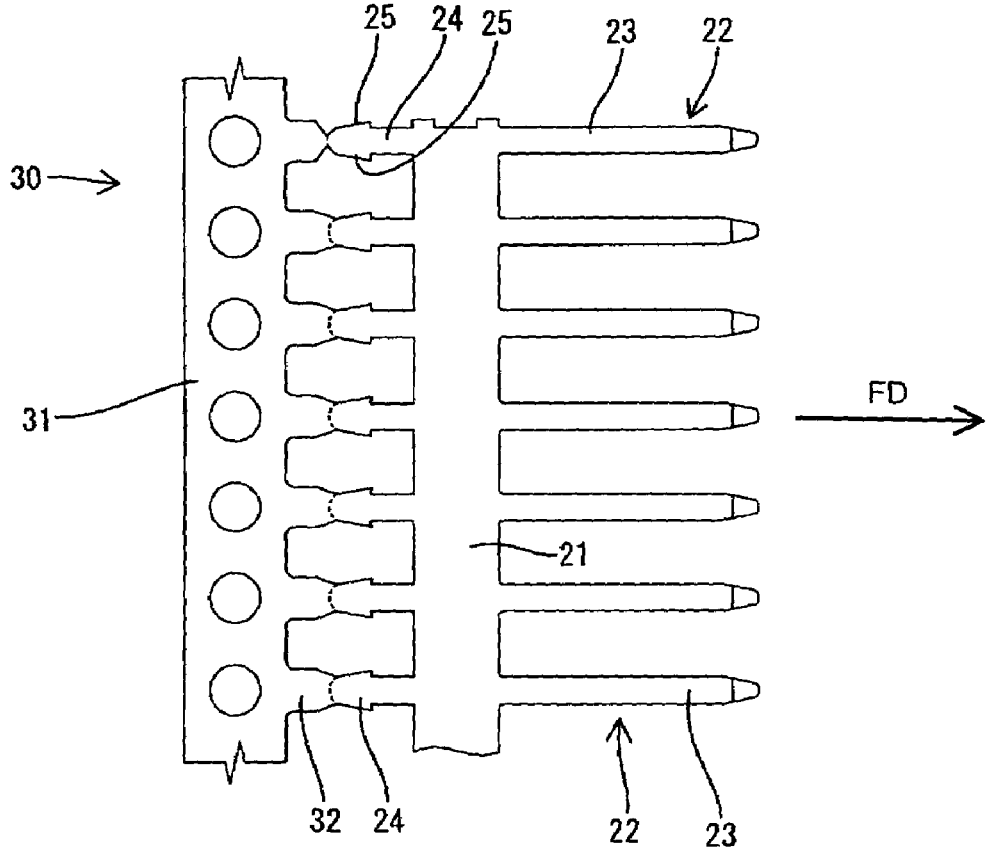
FIG. 9 is a plan view of chained terminals.
Figure 10:
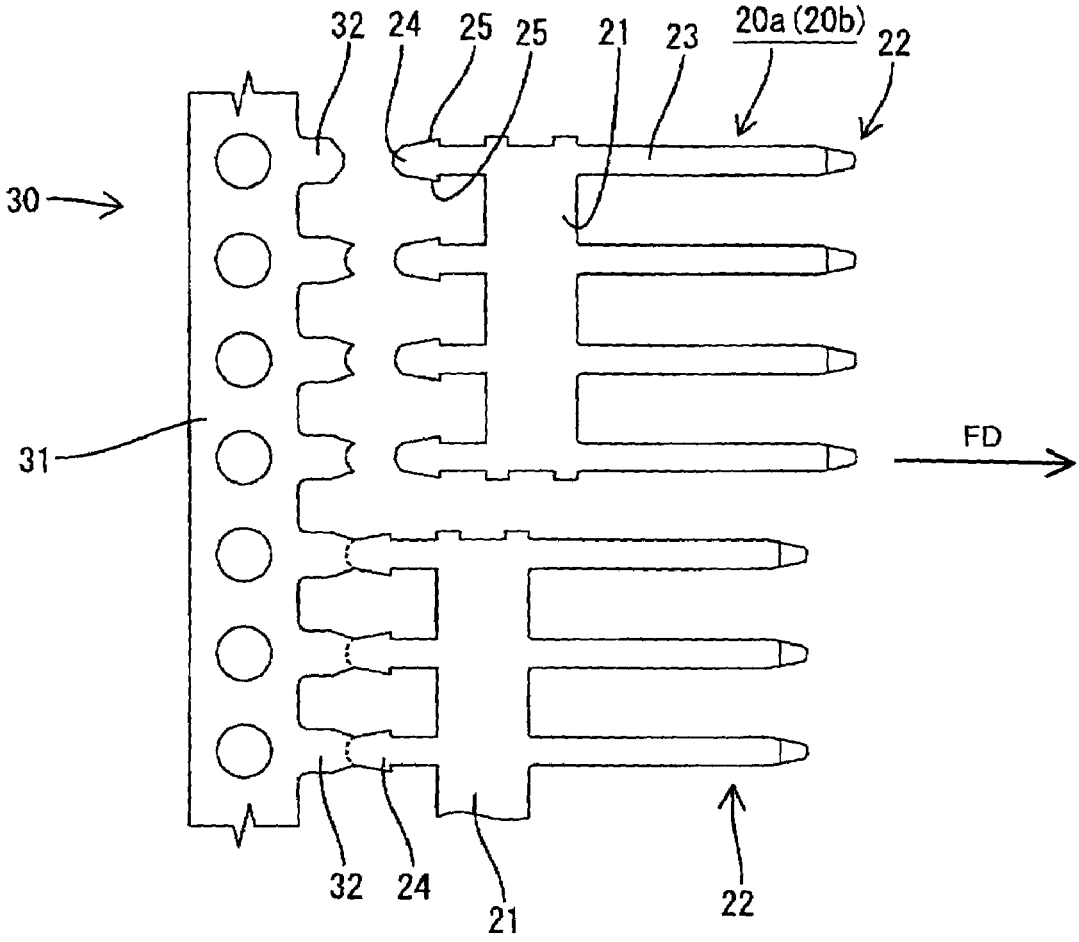
FIG. 10 is a plan view showing a state where a first or second joint terminal is cut off from the chained terminals.
Figure 11:
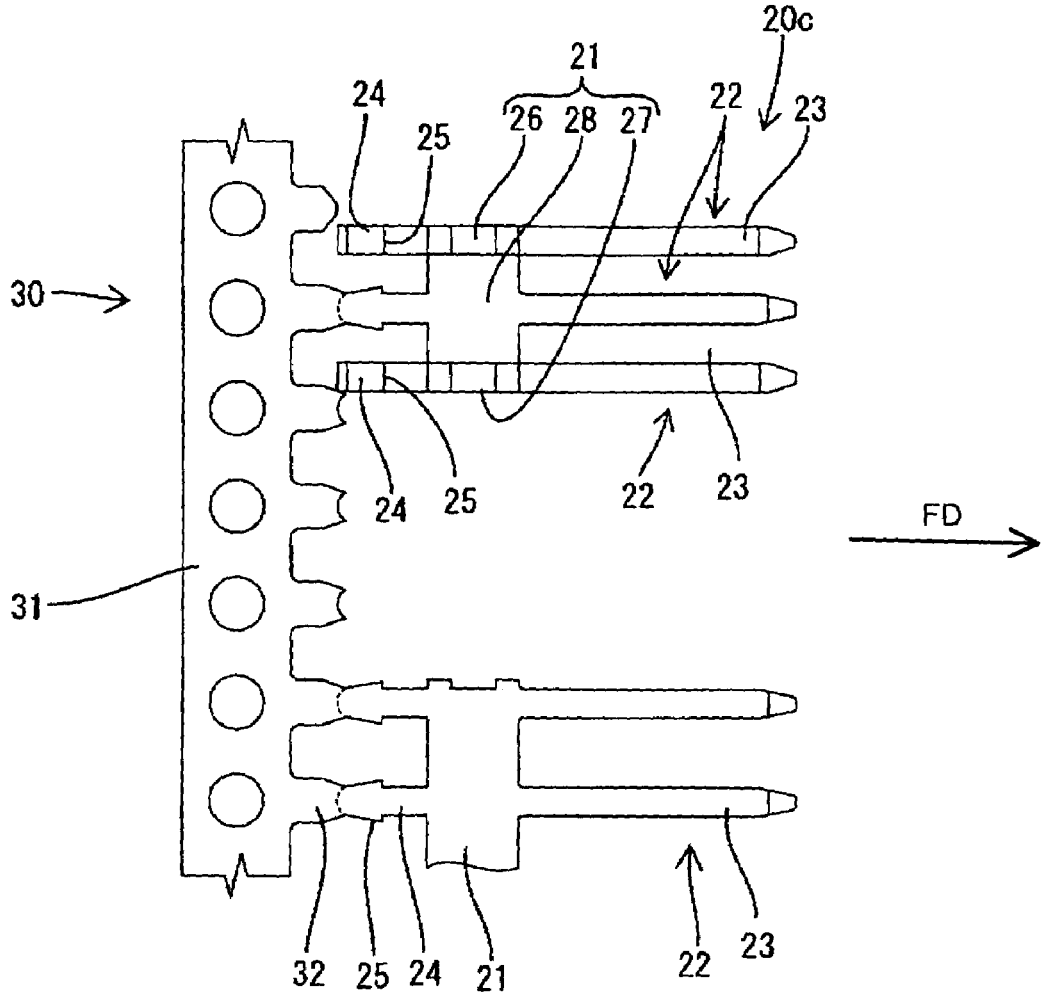
FIG. 11 is a plan view showing a state where a coupling portion of the third joint terminal is bent in the chained terminals.
Figure 12:
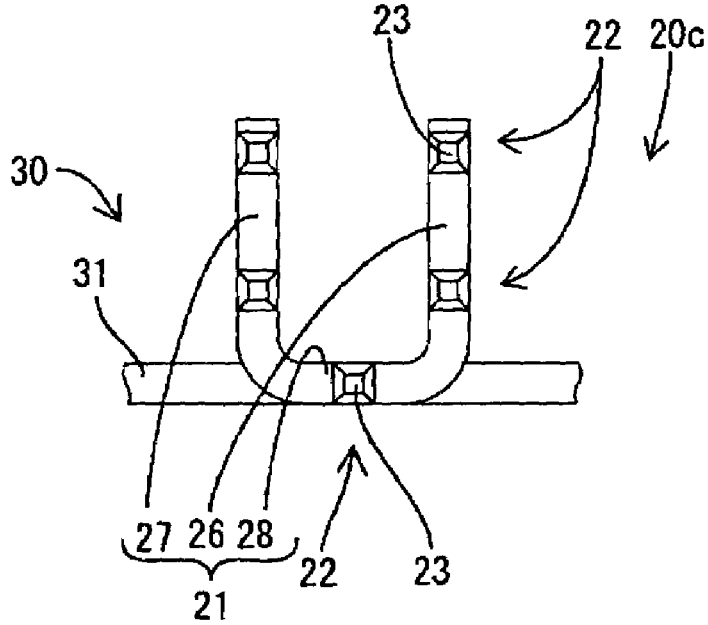
FIG. 12 is a front view showing a state where the coupling portion of the third joint terminal is bent in the chained terminals.
Figure 13:
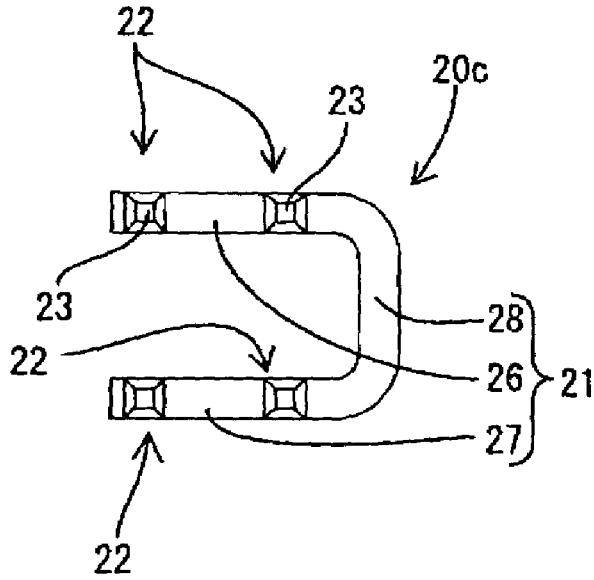
FIG. 13 is a front view of the third joint terminal.
Figure 14:
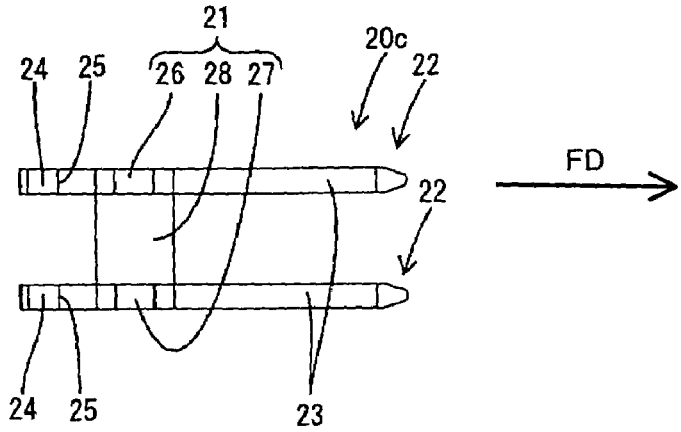
FIG. 14 is a side view of the third joint terminal.

A first embodiment of a joint connector of the invention is described with reference to FIGS. 1 to 14. In the following description, a projecting direction of tabs 22 from a coupling 21 is referred to as a forward direction FD, and reference is made to FIGS. 1 and 2(A) for a transverse direction TD. The terms upper and lower are used herein for convenient reference to the drawings and do not imply a required gravitational orientation for the joint connector.

The joint connector of this embodiment has a housing 10 made e.g. of a synthetic resin and three joint terminals 20*a*, 20*b*, 20*c* are mounted in the housing 10. The joint connector is to be connected with a mating connector (not shown) in which six unillustrated terminal fittings are arranged horizontally substantially side-by-side at specified intervals at each of upper and lower stages. The three joint terminals 20*a*, 20*b*, 20*c* short the twelve terminal fittings in a specified pattern of three separate groups when the joint connector is connected with the mating connector. Specifically, as shown schematically in FIG. 2(B), four terminal fittings at the left side of the upper stage are shorted by the first joint terminal 20*a* to form a first terminal fitting group 1TFG, four terminal fittings at the left side of the lower stage are shorted by the second joint terminal 20*b* to form a second terminal fitting group 2TFG; and two terminal fittings at the right side of the upper stage and two terminal fittings at the right side of the lower stage are shorted by the third joint terminal 20*c* to form a third terminal fitting group 3TFG.

The housing 10 includes a fitting recess 11 with an open front for receiving the mating connector. A press-in groove 12 is formed in the back end surface of the fitting recess 11. The press-in groove 12 has a substantially horizontal upper groove 13, a substantially horizontal lower groove 14, and a vertical interconnecting groove 15 that has upper and lower ends coupled to the right ends of the upper and lower grooves 13, 14. Connection portions between the vertical groove 15 and both the upper and lower grooves 13 and 14 are substantially arcuate. The width along a transverse direction TD of the vertical groove 15 is larger than the heights of the upper and lower grooves 13, 14. Slanted guiding surfaces 16 are formed at the opening edges of the grooves 13, 14, 15 facing the fitting recess 11.

Six narrow holding holes 17 extend back from the rear end surface of each of the upper and lower grooves 13, 14 and are spaced horizontally at specified intervals in the housing 10. The height of the holding holes 17 substantially equals the height of the upper and lower grooves 13, 14. Additionally, the upper and lower surfaces of the upper groove 13 align with the upper and lower surfaces of the holding holes 17. Similarly, the upper and lower surfaces of the lower groove 14 align with the upper and lower surfaces of the holding holes 17. The upper and lower surfaces of both the upper groove 13 and the holding holes 17 have long narrow ribs 18 that extend substantially continuously in forward and backward directions from the front end of the upper groove 13 to the rear ends of the holding holes 17. The upper and lower surfaces of both the lower groove 14 and the holding holes 17 also have long narrow ribs 18 that extend substantially continuously along forward and backward directions from the front end of the lower groove 14 to the rear ends of the holding holes 17. The ribs 18 are narrower than the holding holes 17 and are arranged in an intermediate portion of the holding holes 17. Additionally, the ribs 18 have substantially semicircular cross sections and have slanted front ends that are substantially flush with the guiding surfaces 16.

The first, second and third joint terminals 20*a*, 20*b*, 20*c* all are produced by cutting chained terminals 30 at specified positions. The chained terminals 30 have spaced-apart tabs 22 that project at substantially right angles from a narrow carrier 31 that has a substantially constant width. All of the tabs 22 are coupled by a coupling 21 that is parallel with the carrier 31. One tab 22 is comprised of a narrow contact 23 and a narrow press-in portion 24. The contact 23 projects from a lateral edge of the coupling 21 towards a side opposite from the carrier 31. The press-in portion 24 extends from the coupling 21 towards the carrier 31 and is coupled to a lateral edge of the carrier 31. The contacts 23 and the press-in portions 24 are substantially collinear or parallel with each other. The contacts 23 and the press-in portions 24 are of substantially equal widths. However, the contacts 23 are longer than the press-in portions 24. Locks 25 project from opposite lateral edges of the press-in portions 24 near the ends that are coupled to the carrier 31. The width and thickness of the press-in portions 24 is narrowed gradually from the locks 25 towards the back. On the other hand, protrusions 32 project from the edge of the carrier 31 and are coupled to the rear ends of the press-in portions 24. The width and thickness of projecting ends of the protrusions 32 coupled to the press-in portions 24 is narrowed gradually towards the press-in portions 24.

The chained terminals 30 are fed intermittently parallel with the longitudinal direction of the carrier 31 to an automatic mounting machine (not shown) for pressing the joint terminals 20*a*, 20*b*, 20*c* into the housing 10. The first and second joint terminals 20*a*, 20*b* are cut off from the chained terminals 30 and the third joint terminal 20*c* is bent and then cut off during the intermittent feeding of the chained terminals 30. The respective cut-off joint terminals 20*a*, 20*b*, 20*c* then are mounted into the housing 10.

The coupling 21 and the tabs 22 of the first and second joint terminals 20*a*, 20*b* are substantially flush with each other. Ends of the four press-in portions 24 of the joint terminal 20*a*, 20*b* are cut at boundaries to the leading ends of the protrusions 32 so that the cut leading ends of the press-in portions 24 have arcuate contours, and the coupling 21 is cut so that the joint terminal 20*a*, 20*b* is separated from the carrier 31 (see FIG. 10).

The cut-off first and second joint terminals 20*a*, 20*b* are pressed into the press-in groove 12. More particularly, the four press-in portions 24 of each joint terminal 20*a*, 20*b* are pressed individually into the holding holes 17 through the upper groove 13 or the lower groove 14 while plastically deforming the ribs 18. Additionally, the coupling 21 is accommodated in the upper groove 13 or the lower groove 14. Edges of the couplings 21 adjacent the press-in portions 24 contact the rear end surfaces of the upper and lower grooves 13, 14 to locate the pressed-in first and second joint terminals 20*a*, 20*b* at specified positions. Furthermore, the locks 25 at the rear ends of the press-in portions 24 bite into opposite left and right walls of the holding holes 17. Thus, the first and second joint terminals 20*a*, 20*b* are held so as not to come out. The four contacts 23 of each joint terminal 20*a*, 20*b* project forward in the fitting recess 11 for connection with the terminal fittings.

The third joint terminal 20*c* has four tabs 22 coupled by the coupling 21 that is bent into a substantially U-shape. The coupling 21 is comprised of upper and lower supports 26 and 27 and an intermediate portion 28. The upper support 26 is a substantially horizontal flat plate corresponding to the upper groove 13 of the press-in groove 12. The lower support 27 also is a substantially horizontal flat plate and corresponds to the lower groove 14. The flat intermediate portion 28 corresponds to the vertical groove 15 and has opposite upper and lower ends coupled to the right ends of both upper and lower supports 26, 27 by arcuate corners. Left and right tabs 22 are supported on each of the upper and lower supports 26, 27, but no tab 22 is supported on the intermediate portion 28.

The third joint terminal 20*c* is formed by first cutting the coupling 21 of the chained terminals 30 at a specified position to obtain a section in which one coupling 21 couples five parallel tabs 22. The number of tabs 22 is greater than the number of terminal fittings to be shorted by the joint terminal 20*c*. The press-in portions 24 of four tabs 22, excluding the one in an intermediate portion, are cut off from the protrusions 32 to have arcuate contours. In this way, the third joint terminal 20*c* is coupled to the carrier 31 only via the press-in portion 24 of the middle tab 22 projecting from the intermediate portion 28. The third joint terminal 20*c* is to be arranged between two or more different stages of terminal fittings that are to be shorted and spans over them in a direction substantially normal to the arrangement direction AD in which the terminal fittings are arranged in each stage.

The middle tab 22, the protrusion 32 coupled thereto and the intermediate portion 28 of the coupling 21 are pressed from above and below by an unillustrated jig to be substantially coplanar with the carrier 31. The upper and lower supports 26, 27 at opposite sides of the intermediate portion 28 and the four tabs 22 supported thereby are bent to be at substantially right angles to the intermediate portion 28 (see FIGS. 12 and 13). These bent portions are substantially arcuate. The bending forms the coupling 21 into a substantially U-shape. The contact 23 and the press-in portion 24 of the middle tabs 22 projecting from the intermediate portion 28 then are cut off substantially along the lateral edges of the intermediate portion 28. As a result no tab 22 projects from the intermediate portion 28. In this way, the third joint terminal 20*c* is cut off from the carrier 31, thereby completing its production. The press-in portion 24 of the intermediate portion 28 may be left connected to the intermediate portion 28 while separating it from the carrier 31. Moreover, the first and second supports 26, 27 may be bent from the intermediate portion 28 in substantially opposite directions so that the third joint terminal 20*c* may have a flat S-shape. However, it is preferred to bend the first and second supports 26, 27 from the intermediate portion 28 in the same directions because the bending step is performed more easily.

The third joint terminal 20*c* is pressed into the press-in groove 12 with the press-in portions 24 faced forward. Thus, the press-in portions 24 are pressed individually into the holding holes 17 at each of the upper and lower stages through the right side of each of the upper and lower grooves 13, 14 while plastically deforming the ribs 18. Additionally, the coupling 21 is accommodated in the upper and lower grooves 13, 14. As a result, the third joint terminal 20*c* is located at a specified position by the contact of the rear edge of the coupling 21 with the rear end surfaces of the upper and lower grooves 13, 14, and the locks 25 at the rear ends of the press-in portions 24 bite in the opposite left and right walls of the holding holes 17 to prevent the third joint terminal 20*c* from coming out. The four contact portions 23 of the third joint terminal 20*c* are held to project forward at upper and lower stages in the fitting recess 11 and hence are connectable with the terminal fittings at these stages. The intermediate portion 28 of the coupling 21 is accommodated in the vertical groove 15 that interconnects the upper and lower stages. The width of the vertical groove 15 exceeds the thickness of the intermediate portion 28. Thus, there is a clearance between the intermediate portion 28 and the vertical groove 15 and a bending error of the coupling 21 can be taken up by this clearance.

The third joint terminal can be used for shorting terminal fittings at stages separated by one or more intermediate stages merely by providing the intermediate portion 28 with a length to span the increased distance between the stages with the terminal fittings that are to be shorted. Furthermore, the third joint terminal can be used for shorting terminal fittings at three or more stages by providing the intermediate portion with an intermediate support that carries an appropriate number of tabs for shorting the terminal fittings of the intermediate stages. The intermediate support is arranged substantially normal to the intermediate portion. Such intermediate support may be formed by bending the intermediate portion in a substantially S shape having two or more windings or by folding the intermediate portion onto itself. Thus, the intermediate portion may form at least a part of the intermediate support.

As described above, the joint terminals 20*a*, 20*b*, 20*c* and the housing 10 are united by the press-in operation instead of being united by insert molding. Thus, there is no likelihood that the joint terminals 20*a*, 20*b*, 20*c* are deformed by the injection pressure.

Further, production efficiency can be improved by setting a plurality of housings 10 side by side in an automatic machine (not shown) and pressing the joint terminals 20*a*, 20*b*, 20*c* into these housings 10 in one step.

The third joint terminal 20*c* is formed by bending the chained terminals 30 into a substantially U-shape. Thus, a leading section of the chained terminals, with respect to feeding direction, may be bent twice. It is difficult to obtain high dimensional precision if this double bending method is applied to an automatic mounting machine for mounting already-produced joint terminals into housings. However, in this embodiment, the upper and lower supports 26, 27 at opposite sides of the intermediate portion 28 of the coupling 21 are bent at substantially right angles to the intermediate portion 28 while the intermediate portion 28 is held substantially coplanar with the carrier 31. Thus, high dimensional precision can be obtained even in the application to an automatic mounting machine for mounting the joint terminals into the housing 10.

All of the tabs 22 are coupled to the carrier 31 before the coupling 21 of the third joint terminal 20*c* is bent. Thus, the tabs 22 will not deform in the feeding process. Further, the tab 22 is cut off the intermediate portion 28 that requires no tab piece 22 after the bending. Thus, the tabs 22 of the chained terminals 30 can be arranged at specified intervals and the numbers of the tabs 22 at the upper and lower stages can be accommodated flexibly.

Figure 15:
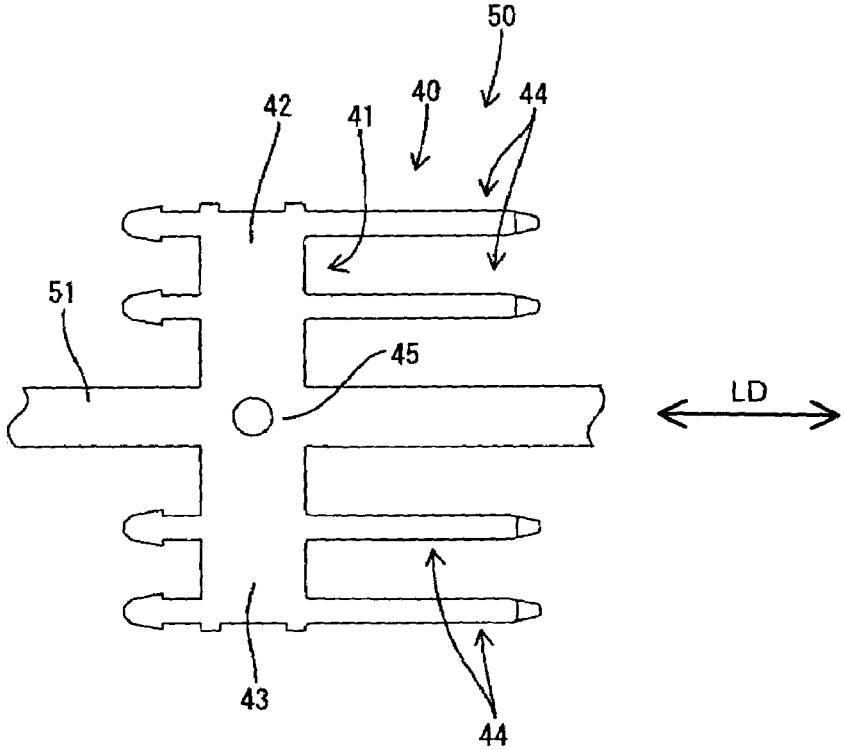
FIG. 15 is a plan view of chained terminals according to a second embodiment.
Figure 16:
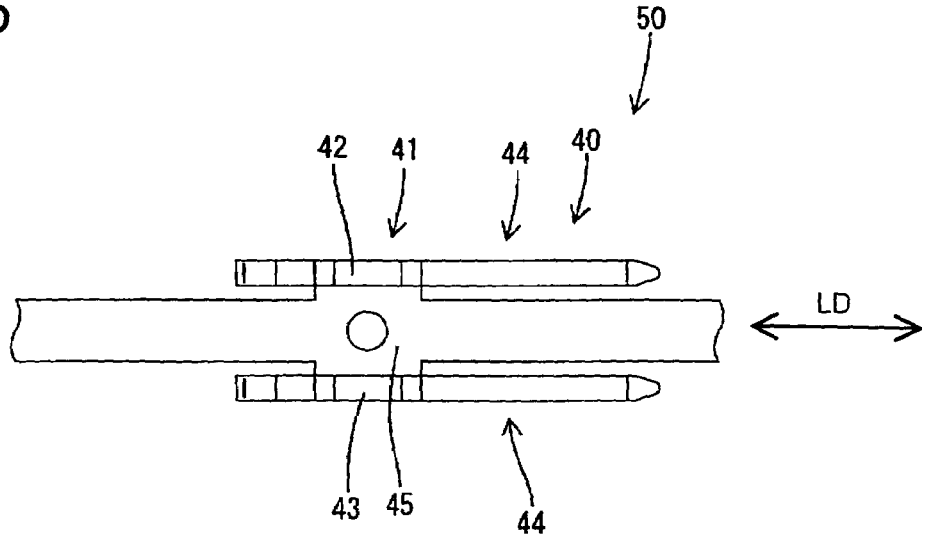
FIG. 16 is a plan view showing a state where a coupling portion of a third joint terminal is bent in the chained terminals.
Figure 17:
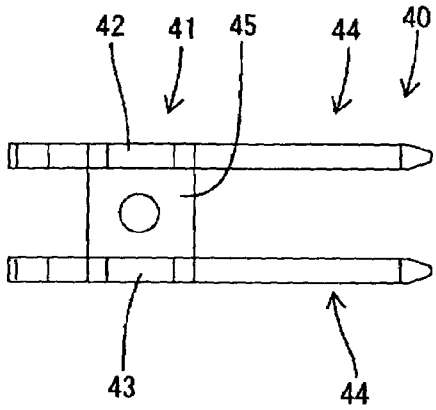
FIG. 17 is a side view of the third joint terminal.

A second embodiment of the invention is illustrated in FIGS. 15 to 17. The second embodiment differs from the first embodiment in the shape of chained terminals 50 used to produce a third joint terminal 40 and the production method for the third joint terminal 40. The other construction is the same as or similar to the first embodiment. Elements that are similar to the first embodiment not described, and merely are identified by the same reference numerals.

The chained terminals 50 of the second embodiment have a coupling 41 with an upper support 42 and a lower support 43 that project from the opposite left and right edges of a carrier 51 at substantially right angles to the longitudinal direction LD of the carrier 51 and substantially coplanar with the carrier 51. Two tabs 44 project substantially parallel with the carrier 51 from each of the upper and lower supports 42, 43. Thus, a part of the carrier 51 also serves as an intermediate portion 45 of the coupling 41.

The third joint terminal 40 is produced by holding a part of the carrier 51 corresponding to the intermediate portion 45 so as not to move vertically. The upper and lower supports 42, 43 then are bent at substantially right angles to the intermediate portion 45 in this state (see FIG. 16) to form the U-shaped coupling 41. Thereafter, the carrier 51 is cut substantially along the opposite lateral edges of the upper and lower supports 42, 43 to cut the third joint terminal 40 off from the chained terminals 50 (see FIG. 17).

In the second embodiment, the couplings 41 extend from the opposite lateral edges of the carrier 51 and a part of the carrier 51 forms the intermediate portion 45 with the already-bent coupling 41 cut off from the carrier 51. The intermediate portion 45 includes part of the carrier 51. Thus, a material loss is small as compared to a case where the entire coupling is formed separately from the carrier.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Two tabs are provided at each of the upper and lower stages in the third joint terminal of the foregoing embodiments. However, one, three or more tabs may be provided at both upper and lower stages according to the invention. In case only one tab piece is provided at one stage, the third joint terminal may substantially have an L-shape.

The tabs project from the front and rear edges of the coupling by crossing the coupling portion in the foregoing embodiments. However, the tabs may project only from the front edge of the coupling according to the invention.

Although twelve terminal fittings are provided in the foregoing embodiments, more or fewer terminal fittings may be provided.

The terminal fittings are divided into three groups for shorting in the foregoing embodiments. However, the shorting pattern may divide the terminal fittings into two, four or more groups according to the invention.

The third joint terminal couples terminal fittings on different stages that are close to each other in the above embodiments. However, the third joint terminal may couple terminal fittings provided on stages separated from each other by further stages. In such case, the intermediate portion has a dimension that corresponds to the distance separating the stages to be coupled.

What is claimed is:

1. A joint terminal comprising a nonplanar coupling configured for being pressed into a housing of a joint connector, the coupling having a first support lying in a first plane, a second support lying in a second plane and an intermediate portion extending unitarily between the first and second supports, at least one first contact having a first longitudinal central axis extending in a first direction from the first support and lying substantially in the first plane and at least one second contact having second longitudinal central axis extending in the first direction from the second support and lying substantially in the second plane so that the first and second contacts are substantially parallel to one another, the joint terminal further comprising a plurality of press-in portions extending in a second direction from the coupling, the second direction being opposite to the first direction, wherein the pressing portions are substantially collinear with the first and second axes respectively.

2. The joint terminal of claim 1, wherein the intermediate portion has no contact.

3. The joint terminal of claim 1, wherein the press-in portion has a lock formed at a position spaced from the coupling.

4. The joint terminal of claim 3, wherein an end of the lock farthest from the coupling defines an arcuate point.

5. The joint terminal of claim 4, wherein the lock has two opposite projections between the arcuate point and the coupling.

6. A joint connector comprising housing with a fitting recess having an open front end configured for receiving a mating connector, a rear wall facing the open front end, a press-in groove being formed in the rear wall and opening into the fitting recess, the press-in groove having a first and second substantially parallel groove sections and a interconnecting groove section extending angularly between the first and second groove sections, holding holes formed in the first and second groove sections and extending rearwardly into the rear wall, at least one joint terminal having a nonplanar coupling with first and second supports press fit respectively into the first and second groove sections and an intermediate portion extending unitarily between the first and second supports and received in the intermediate section of the press-in groove, press-in portions extending in a rearward direction from the first and second supports and being pressed into the holding holes, at least one first contact having a first longitudinal center axis extending in a forward direction from the first support and at least one second contacts having a second longitudinal center axis extending in the forward direction from the second support so that the first and second contacts are substantially parallel to one another and so that the pressing portions are substantiallly collinear with the first and second axis respectively.

* * * * *